United States Patent [19]

Takata et al.

[11] 4,248,938

[45] Feb. 3, 1981

[54] PROCESS FOR PREPARING POLYESTER FIBER COMPOSITE MATERIALS USEFUL FOR REINFORCING RUBBER ARTICLES

[75] Inventors: Tadahiko Takata, Ibaraki; Masaya Kamiyoshi, Ashiya; Satoshi Tanaka, Ibaraki, all of Japan

[73] Assignee: Teijin Limited, Osaka, Japan

[21] Appl. No.: 958,739

[22] Filed: Nov. 8, 1978

[30] Foreign Application Priority Data

Nov. 15, 1977 [JP] Japan ..... 52-136233
Dec. 12, 1977 [JP] Japan ..... 52-148120

[51] Int. Cl.[3] ..... C09J 5/00; D02G 3/48

[52] U.S. Cl. ..... 428/414; 428/395; 428/423.7; 428/423.9; 428/424.7; 427/386; 156/110 A; 428/424.8

[58] Field of Search ..... 428/424, 395; 156/314, 156/330, 110 A; 427/386

[56] References Cited

U.S. PATENT DOCUMENTS

| | | | |
|---|---|---|---|
| 3,307,966 | 3/1967 | Shoaf | 428/395 |
| 3,460,973 | 8/1969 | Hantzer et al. | 427/381 |
| 3,464,878 | 9/1969 | Schwarz | 156/330 |
| 3,503,845 | 3/1970 | Hollatz | 156/330 |
| 3,897,585 | 7/1975 | Wood | 156/110 A |

FOREIGN PATENT DOCUMENTS

| | | | |
|---|---|---|---|
| 1056798 | 1/1967 | United Kingdom | 157/330 |
| 1097880 | 1/1968 | United Kingdom . | |

*Primary Examiner*—Ralph S. Kendall
*Attorney, Agent, or Firm*—Ryan and Wayne Burgess

[57] ABSTRACT

A process for preparing a polyester fiber composite material having an excellent bonding property to rubber, a proper softness and a high resistance to fatigue, comprises the steps of first impregnating a polyester fiber material much as fabric, cord or thread, with a first treating liquid containing (A) a polyepoxide compound having two or more epoxy groups per molecule of the compound, (B) a blocked polyisocyanate compound, for example, an addition product of a polyisocyanate compound with a phenol, tertiary alcohol or aromatic secondary amine compound and (C) a rubber latex such as vinyl pyridine-styrene-butadiene terpolymer latex; first drying and heat treating the first impregnated material at a temperature of, preferably, 180° C. or higher but lower the melting point of the polyester fiber material; second impregnating the first impregnated and heat-treated material with a second treating liquid containing a resorcinformaldehyde reaction product, a rubber latex and, optionally, an ethylene urea compound of the formula

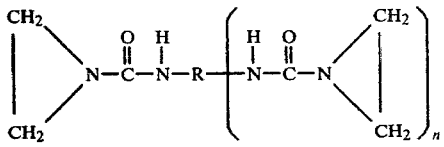

wherein R is an aromatic or aliphatic hydrocarbon residue and n is 0.1 or 2, and; second drying and heat-treating the second impregnated material at a temperature of, preferably, 120° C. or more but lower than the melting point of the polyester fiber material.

39 Claims, No Drawings

PROCESS FOR PREPARING POLYESTER FIBER COMPOSITE MATERIALS USEFUL FOR REINFORCING RUBBER ARTICLES

FIELD OF THE INVENTION

The present invention relates to a process for preparing a polyester fiber composite material useful for reinforcing rubber articles. More particularly, the present invention relates to a process for preparing a polyester fiber composite material which has an excellent bonding property to rubber, a proper softness and an excellent resistance to fatigue fracture and, therefore, is useful for reinforcing rubber articles.

BACKGROUND OF THE INVENTION

It is known that polyester fiber materials such as polyester fiber fabrics, polyester fiber cords and polyester fiber threads, have an excellent tensile strength and dimensional stability, and therefore, are useful as a reinforcing material for car tires, conveyer belts, V-belts and hoses. However, since the polyester fiber materials inherently have a poor bonding property to rubber, in order to utilize the polyester fiber material as a reinforcing material for rubber articles, it is required to significantly improve the bonding property of the polyester fiber material to rubber. For this reason, a number of approaches have been taken in attempts to improve the bonding property of the polyester fiber material to rubber. However, during the approaches, it was found that the improvement in the bonding property of the polyester fiber material to rubber causes the resultant improved polyester fiber material to have an excessively high stiffness, a poor processability in the shaping or molding process and a poor resistance to fatigue fracture. For example, U.S. Pat. No. 3,307,966 discloses a process for improving the bonding property of the polyester fiber material to rubber, by first impregnating the polyester fiber material with a first treating liquid containing a polyepoxide compound and an aromatic polyisocyanate compound, and then, by second impregnating the first impregnated polyester fiber material with a second treating liquid containing a reaction product of resorcin with formaldehyde and a rubber latex. The resultant product of the above-mentioned process exhibits a relatively superior bonding property to rubber. However, this known process causes the resultant product to have a relatively high stiffness and, therefore, it is difficult to bend the product during the shaping operation, and the product has a remarkably decreased resistance to fatigue fracture.

Japanese Patent Application Publication (Kokoku) No. 42-9004 discloses a process in which a polyester fiber material is treated with a first treating liquid containing an epoxy resin, a ethyleneimine compound and a rubber latex and, thereafter, the thus treated polyester fiber material is further treated with a second treating liquid containing a reaction product of resorcin with formal dehyde and a rubber latex. Also, U.S. Pat. No. 3,460,973 discloses a process in which a polyester fiber material is treated with a first treating liquid containing a lactam-blocked polyisocyanate compound, an emulsifying agent and a rubber latex, and then, with a second treating liquid containing a reaction product of resorcin with formaldehyde and a rubber latex. Furthermore, British Pat. No. 1,056,798 discloses a process in which a polyester fiber material is treated with a single treating liquid containing a blocked isocyanate compound, an epoxy resin and a rubber latex without using an additional treating liquid containing a resorcin-formaldehyde resin and a rubber latex. The above-mentioned three processes cause the resultant products to have a proper softness. However, these resultant products have a relatively low bonding property to rubber and, therefore, a poor rubber coverage. The term "rubber coverage" used herein refers to a percentage of total area of portions of the reinforcing material covered with rubber when the reinforcing material is peeled off from the rubber article in which the reinforcing material is embedded with in a rubber matrix.

As is clear from the above description, the conventional processes all failed to satisfy all of the requirements of the proper softness, high bonding property to rubber and high resistance to fatigue fracture of the rubber reinforcing polyester fiber materials.

SUMMARY OF THE INVENTION

The object of the present invention is to provide a process for preparing a polyester fiber material useful for reinforcing rubber articles, which material has an excellent bonding property to rubber, a proper softness and a high resistance to fatigue fracture.

The above-mentioned object can be attained by the process of the present invention comprising the steps of:

first impregnating a polyester fiber material with a first treating liquid containing a first treating composition which comprises (A) at least one polyepoxide compound, (B) at least one blocked polyisocyanate compound and (C) at least one rubber latex, the ratio in dry weight of said polyepoxide compound to the sum of said polyepoxide compound and said blocked polyisocyanate compound being in a range of from 0.05 to 0.9, and the ratio in dry weight of said rubber latex to the sum of said polyepoxide compound and said blocked polyisocyanate compound being in a range of from 0.5 to 15;

first drying and heat-treating said first impregnated polyester fiber material at a temperature lower than the melting point of said polyester fiber material;

second impregnating said first dried and heat-treated polyester fiber material with a second treating liquid containing a second treating composition which contains (D) a reaction product between resorcin and formaldehyde and (E) at least one rubber latex, and;

second drying and heat-treating said second impregnated polyester fiber material at a temperature lower than the melting point of said polyester fiber material.

The polyester fiber material usable for the process of the present invention may consist of a fiber-forming linear polyester, for example, polyethylene terephthalate or polyethylene naphthalate. The polyester fiber material may be in the forms of fabric, cord and thread made of the polyester fibers or filaments. The form of the polyester fiber material varies in accordance with the use thereof. However, the form of the polyester fiber material may be changed during the process of the present invention. For example, in the process of the present invention, it is possible to apply the first impregnating operation to polyester fiber threads, and after the drying and heat-treating process is finished, the threads are converted into a cord or fabric, and, thereafter, the second impregnating operation is applied to the cord or fabric. Otherwise, it is possible for the threads to be converted into a cord, the first impregnating operation and the first drying and heat-treating operation are applied to the cord, the cord is converted into a fabric and, thereafter, the second impregnating operation is applied to the fabric.

The polyepoxide compound usable for the process of the present invention contains at least two epoxy group per molecule of the compound, the amount of the epoxy groups in the compound being a gram equivalent of 0.2 or more per 100 g of the compound. The polyepoxide compound may be selected from the group consisting of reaction products of polyhydric alcohols with halogenated epoxide compounds, reaction products of polyhydric phenol compounds with halogenated epoxide compounds and oxidation products of unsaturated organic compounds having at least one aliphatic double bond with peracetic acid or hydrogen peroxide. The above-mentioned polyhydric alcohol may be selected from the group consisting of ethylene glycol, glycerol, sorbitol, pentaerythritol and polyethylene glycols. Also, the above-mentioned halogenated epoxide compound is epichlorohydrin. The polyhydric phenol compound mentioned above may be selected from the group consisting of resorcin, bis (4-hydroxyphenyl) dimethylmethane, phenol-formaldehyde resins and resorcin-formaldehyde resins. Furthermore, the above-mentioned oxidation product may be selected from the group consisting of 4-vinylcyclohexene dioxide, 3,4-epoxycyclohexylmethyl-3,4-epoxycyclohexene carboxylate and bis (3,4-epoxy-6-methyl cyclohexylmethyl) adipate. The preferable polyepoxide compound for the process of the present invention may be selected from polyglycidyl ethers of polyhydric alcohols, which are reaction products of polyhydric alcohols with epichlorohydrin.

The above-mentioned polyepoxide compound may be used in the state of an aqueous emulsion or solution for the process of the present invention. In order to prepare the aqueous emulsion or solution, the polyepoxide compound is directly, or optionally after dissolving it in a small amount of a solvent, emulsified or dissolved in water, if necessary, in the presence of a surface active agent (emulsifying agent), for example, sodium alkylbenzene sulfonate.

The blocked polyisocyanate usable for the process of the present invention may be selected from addition products of polyisocyanate compounds with blocking agents, which products are capable of releasing the blocking components therefrom by heating so as to produce reactive polyisocyanate compounds. The polyisocyanate compound may be selected from the group consisting of tolylene diisocyanate, m-phenylene diisocyanate, diphenylmethane diisocyanate, hexamethylene diisocyanate, polymethylenepolyphenyl isocyanate, triphenylmethane triisocyanate and aducts of polyalkylene glycols with polyisocyanates. The aducts of polyalkylene glycols with polyisocyanates have —NCO groups located at the terminals of the molecules and are obtained by reacting a polyisocyanate with a compound having two or more reactive hydrogen atoms per molecule of the compound, for example, trimethylole propane and pentaerythritol in a molar ratio of —NCO groups to —OH groups of 1 or more. The preferable polyisocyanate may be selected from aromatic polyisocyanates such as tolylene diisocyanate, diphenylmethane diisocyanate and polymethylenepolyphenylisocyanate.

The blocking agent usable for the preparation of the blocked polyisocyanate compound may be selected from the group consisting of phenol compounds, for example, phenol, thiophenol, cresol and resorcin; tertiary alcohol compounds, for example, t-butyl alcohol and t-pentyl alcohol; aromatic secondary amine compounds, for example, diphenyl amine and xylidine; aromatic imide compounds, for example, phthalic acid imide; lactam compounds, for example, caprolactam and valerolactam; oxime compounds, for example, acetoxim, methylethylketone oxime and cyclohexane oxime; and sodium hydrogen sulfite.

Each of the rubber latexes (C) and (E) usable for the process of the present invention may be selected from the group consisting of natural rubber latexes and synthetic rubber latexes, for example, styrene-butadiene copolymer latexes, vinyl pyridine-styrene-butadiene terpolymer latexes, nitrile rubber latexes and chloroprene rubber latexes. Of the synthetic rubber latexes, the most preferable consists of a vinylpyridine-styrene-butadien terpolymer latex alone or contains at least 50% by weight of the above-mentioned terpolymer latex.

In the first treating composition, it is necessary that the ratio in dry weight of the polyepoxide compound (A) to the sum of the blocked polyisocyanate compound (B) and the rubber latex (C), that is, (A)/[(A)+(B)], be in a range of from 0.05 to 0.9, preferably, from 0.1 to 0.5, and the ratio in dry weight of the rubber latex (C) to the sum of the polyepoxide compound (A) and the blocked polyisocyanate compound (B), that is, (C)/[(A)+(B)], be in a range of from 0.5 to 15, preferably, from 1 to 10. If the ratio (A)/[(A)+(B)] falls outside the above-mentioned range, the resultant reinforcing polyester fiber material will have a poor bonding property to rubber and, therefore, a poor rubber coverage. A ratio (C)/[(A)+(B)] smaller than the lower limit, 0.5, will cause the resultant reinforcing polyester fiber material to have a excessively high stiffness and a poor resistance to fatigue fracture. Also, a ratio (C)/[(A)+(B)] larger than 15 will result in a poor bonding property of the resultant reinforcing polyester fiber material to rubber.

The first treating composition may be emulsified or dispersed in water by using a proper surface active agent, such as emulsifying or dispersing agent, in an amount of, preferably, 15% or less, more preferably, 15% or less, based on the total dry weight of the first treating composition. When the surface active agent is used in an amount larger than 15%, the resultant reinforcing polyester fiber material may tend to have a relatively poor bonding property to rubber.

The first treating liquid usable for the process of the present invention contains the first treating composition emulsified or dispersed preferably in a content in dry weight of from 1 to 30%, more preferably, from 3 to 20%. When the amount of the first treating composition is smaller than 1%, the resultant reinforcing polyester fiber composite material might have a relatively poor bonding property to rubber. Also, the use of the first treating composition in an amount larger than 30% will result in an excessively large stiffness and a poor resistance to fatigue fracture of the resultant reinforcing polyester fiber compsite material.

The second treating liquid usable for the process of the present invention contains a second treating composition which contains a reaction product (D) of resorcin with formaldehyde and at least one rubber latex (E). It is preferable that the molar ratio of resorcin to formaldehyde is in a range of from 1:0.5 to 1:8, more preferably, from 1:0.5 to 1:1, most preferably, from 1:1 to 1:4. Also, it is preferable that the ratio in dry weight of the resorcin-formaldehyde resin (D) to the rubber latex (E)

is in a range of from 1:1 to 1:20, more preferably, from 1:3 to 1:20. If the molar ratio of resorcin to formaldehyde and the dry weight ratio of the resorcin-formaldehyde resin (D) to the rubber latex (E) fall outside the above-mentioned ranges, respectively, the resultant reinforcing polyester fiber composite material might have a relatively poor bonding property to rubber. The rubber latex (E) to be contained in the second treating liquid may be the same as the rubber latex (C) to be contained in the first treating liquid and, therefore, preferably may be selected from latexes consisting of vinyl pyridine-styrene-butadiene terpolymer latexes alone or containing at least 50% by weight of the above-mentioned terpolymer latexes.

In the preparation of the second treating liquid, the resorcin-formaldehyde resin (D) can be aged together with the rubber latex (E) at a temperature of from 15° to 20° C. for 15 hours or more, so as to allow them to react with each other and to provide a so-called "RFL" resin.

The second treating composition may contain, in addition to the resorcin-formaldehyde resin (D) and the rubber latex (E), at least one ethylene urea compound of the formula:

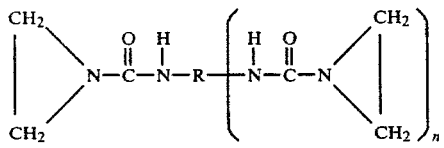

wherein R stands for an aromatic or aliphatic hydrocarbon residue and n is 0, 1 or 2.

The ethylene urea compound defined above may be a reaction product of ethyleneimine with an isocyanate selected from the group consisting of octadecylisocyanate, hexamethylenediisocyanate, isophoronediisocyanate, tolylenediisocyanate, methaxylenediisocyanate, diphenylmethane diisocyanate, naphthylenediisocyanate, and triphenylmethanetriisocyanate. The most preferable ethylene urea compounds are aromatic ethylene urea compounds such as diphenylmethane diethylene urea.

In the preparation of the second treating liquid, it is preferable that the ethylene urea compound be used in an amount of from 0.5 to 30%, more preferably, from 1.0 to 20%, based on the total dry weight of said resorcin-formaldehyde reaction product (D) and the rubber latex (E). When the ethylene urea compound is used in an amount less than 0.5%, the resultant reinforcing polyester fiber composite material may have a relatively poor bonding property to rubber and rubber coverage. If the amount of the ethylene urea compound in the second treating composition is larger than 30%, the second treating liquid will have such a remarkably increased viscosity that the impregnating operation of the polyester fiber material becomes very difficult and the resultant product has an undesirably high stiffness. The use of more than 30% of the ethylene urea compound results in an undesirably high cost of the resultant product, and does not increase the bonding property to rubber and the rubber coverage of the resultant product to more than that produced by using the ethylene urea compound in an amount of 30%.

It is preferable that the total weight content of the second treating composition composed of the resorcin-formaldehyde reaction product (D), the rubber latex (E) and, optionally, the ethylene urea compound, in the second treating liquid be in a range of from 10 to 25%.

The second treating liquid may contain, in addition to the second treating composition, an additional adhesive, and a stabilizing agent for the second treating liquid. In this case, it is preferable that the total dry weight content of the resorcin-formaldehyde reaction product (D) and the rubber latex (E) is 50% or more based on the weight of the second treating liquid.

The ethylene urea compound can be added to the second treating liquid either before or after the resorcin-formaldehyde reaction product (D) and the rubber latex (E) are added into the second treating liquid. When the ethylene urea compound is used, the resorcin-formaldehyde reaction product (D) and the rubber latex (E) are usualy aged together. However, when the ethylene urea compound is not used, the aging operation may be either carried out or not.

When the second treating composition contains the ethylene urea compound, it is preferable that the ratio in dry weight of the resorcin-formaldehyde reaction product (D) to the rubber latex (E) be in range of from 1:1 to 1:15, more preferably, from 1:3 to 1:12.

When the second treating liquid containing the ethylene urea compound is applied to the polyester fiber material and, then, heat-treated, the ethylene imine rings in the ethylene urea compound molecules are opened, and the resultant compound reacts with the co-existing compounds, that is, the resorcin-formaldehyde reaction product (D) and/or the rubber latex (E) in the second treating composition, so as to increase the bonding property of the resultant reinforcing polyester fiber composite material. Compared with this, in the case of the blocked polyisocyanate compound, the heat-treatment results in the release of the blocking component from the blocked polyisocyanate compound so as to generate the reactive polyisocyanate compound. Accordingly, it is evident that the reaction mechanism of the ethylene urea compound during the second heat-treatment should be definitely distinguished from that of the blocked polyisocyanate compound during the first heat-treatment.

The addition of the ethylene urea compound to the second treating composition results in a high bonding property to rubber and a proper softness of the resultant reinforcing polyester fiber composite material. Furthermore, it should be noted that the thermal convention of the ethylene urea compound releases no component therefrom and, therefore, does not pollute the environment of the reaction.

The impregnating operations of the first and second treating liquids can be effected by using any conventional impregnating methods, for example, roller coating method, spraying method, brushing method and immersing (dipping) method, etc. In the first impregnating operation, it is preferable that the resultant first impregnated polyester fiber material contains 0.1 to 10%, more preferably, 0.5 to 5%, in dry weight, of the first treating composition, based on the weight of the polyester fiber material. Also, in the second impregnating operation, it is preferable that the resultant second impregnated polyester fiber material contains 0.5 to 10%, more preferably, 1 to 5%, in dry weight, of the second treating composition, based on the weight of the polyester fiber material. In order to control the amount of the first or second treating liquid to be impregnated in the polyester fiber material, an excessive amount of the treating liquid applied into the polyester fiber material may be removed by squeezing by means of a pair of nip rollers, scraping by means of a scraper, blowing away by means of an air jet, sucking by means of a vacuum device, absorbing by means of absorbing material or heating away by means of a heater.

After the completion of the first impregnating operation, the first impregnated polyester fiber material is subjected to a drying and heat-treating operation at a temperature lower than the melting point of the polyester fiber material, preferably, 180° C. or higher, but lower than the melting point of the polyester fiber material, more preferably, in a range of from 220° to 250° C. Also, after the second impregnating operation is completed, the second impregnated polyester fiber material is dried and heat-treated at a temperature lower than the melting point of the polyester fiber material, preferably, 120° C. or more but lower than the melting point of the polyester fiber material, more preferably, in a range of from 180° to 250° C. However, each of the first and second drying and heat-treating temperatures should be adjusted to a level which is high enough to cause the resultant product to have a satisfactory bonding property to rubber. If the drying and heat-treating temperature is higher than the melting point of the polyester fiber material, the drying and heat-treating operation will couse the resultant product to have polyester fibers melted and adhering to each other and to have a remarkably decreased tensile strength. Accordingly, in this case, the resultant product is practically useless.

As is clear from the above description, the polyester fiber composite material prepared in accordance with the process of the present invention, comprises a polyester material; a first impregnating composition layer with which the polyester fiber material is impregnated, which comprises (A) at least one polyepoxide compound, (B) at least one blocked polyisocyanate compound and (C) at least one rubber latex and which has been heat-treated at a temperature lower than the melting point of the polyester fiber material, the ratio in dry weight of the polyepoxide compound to the sum of the said polyepoxide compound and the blocked polyisocyanate compound being in a range of from 0.05 to 0.9, and the ratio in dry weight of the rubber latex to the sum of the polyepoxide compound and the blocked polyisocyanate compound being in a range of from 0.5 to 15, and; a second impregnating composition layer which is formed on the first impregnating composition layer, which contains (D) a reaction product of resorcin with formaldehyde and (E) at least one rubber latex and which has been heat-treated at a temperature lower than the melting point of the polyester fiber material.

The second impregnating composition layer may contain in addition to the resorcin-formaldehyde reaction product (D) and the rubber latex (E) at least one ethylene urea compound of the formula:

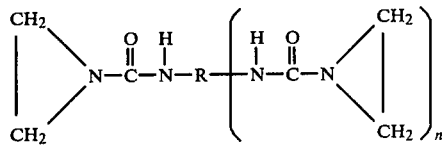

wherein R and n are the same as defined hereinbefore.

The polyester fiber composite material of the present invention is very useful as an reinforcing material for rubber articles. That is, the reinforcing polyester fiber composite material of the present invention has an excellent tensile strength, dimensional stability, and other properties required to the reinforcing materials. Also, the reinforcing material of the present invention exhibits a proper softness and, therefore, has a high processability in the shaping or molding process and a high resistance to fatigue fracture. Furthermore, when embedded and vulcanized in a rubber composition, the reinforcing polyester fiber composite material of the present invention exhibits an excellent bonding property to rubber and a high rubber coverage. The specific examples presented below will serve to more fully explain how the present invention is practiced. However, it will be understood that these examples are only illustrative and in no way limit the present invention.

In the examples, the following tests were carried out on the resultant products.

1. Peeling resistance

Two tire cords each having a density of 27 threads/2.5 cm were superimposed on each other at an angle of 90 degrees from each other and treated in accordance with the process of the present invention. The resultant reinforcing ply embedded within a rubber composition for producing a carcass of a tire for an automobile. The rubber composite article thus prepared was subjected to a vulcanizing operation in a press at a temperature of 160° C. for 20 minutes.

In order to determine the bonding strength of the reinforcing ply to rubber, the reinforcing ply was peeled off from the rubber matrix at a rate of 200 cm/minutes. The load required to peel off the reinforcing ply from the rubber matrix was shown in a unit of kg/3 cm.

2. Rubber coverage

After the above-mentioned reinforcing ply was peeled off from the rubber matrix, the surface of the reinforcing ply was observed with the naked eye the percentage of a total area of portions of the reinforcing ply surface covered by the rubber based on the whole area of the surface was determined.

3. Resistance to bending

The resistance of the above-mentioned reinforcing ply to bending was determined by using a Gurley type stiffness tester disclosed in U.S. Pat. No. 3,575,761.

4. Resistance to fatigue

A test specimen was placed between rotating disks of a Goodrich type disk tester and repeatedly subjected 3.5 million times to stretching at a percent elongation of 6% and compressing at a percent compression of 18%. The tensile strength ($X_0$) of the specimen before testing was determined, and after the completion of the testing process, the remaining tensile strength ($X_1$) of the specimen was determined. The percentage of the remaining tensile strength of the specimen after the testing process based on that before testing was calculated in accordance with the equation:

$$\text{Remaining tensile strength}(\%) = (X_1/X_0) \times 100$$

EXAMPLE 1 AND COMPARATIVE EXAMPLE 1 TO 3

In Example 1, 6 g of sorbitol triglycidyl ether, which was available in the trademark of DENACOL EX-611 of NAGASE SANGYO, Japan, were uniformly mixed with 4 g of an aqueous solution of 30% by weight of sodium dioctylsulfosuccinate, which was available under the trademark of NEOCOL SW-30, of DAIICHI KOGYO SAIYAKU, Japan, and the resultant mixture was uniformly dissolved in 805 g of water by vigorously stirring. Separately, 14 g of phenol-blocked 4,4'-diphenylmethane diisocyanate, which was available under the trademark of Hylen MP, of Du Pont, 4 g of the aqueous solution of 30% by weight of sodium dioctylsulfosuccinate and 42 g of water were uniformly mixed together in a ball mill for 24 hours. The resultant dispersion was uniformly mixed with the obtained as mentioned above and 125 g of an aqueous emulsion of 40% by weight of vinyl pyridine-styrene-butadiene terpolymer, which was available under the trademark of NIPPOL 2518FS, of NIPPON ZEON, Japan, to prepare a first treating liquid.

Separately, 22 g of resorcin, 29 g of an aqueous solution of 37% by weight of formaldehyde, 31 g of an aqueous solution of 28% by weight of ammonia and 500 g of water were mixed together, and the mixture was stirred at a temperature of 25° C., for 3 hours, to provide a resorcin-formaldehyde reaction product. The reaction mixture was added to 418 g of the aqueous solution of 40% by weight of a vinyl pyridine-styrene-butadiene terpolymer, and the mixture was aged at a temperature of 25° C., for 48 hours, while stirring to prepare a second treating liquid.

A cord which was composed of polyethylene terephthalate filament yarns, each having a first twisting number of 40 turns/10 cm, a ply twisting number of 40 turns/10 cm, and a denier of 1500/2 plies, was continuously impregnated in a machine which was available under the trademark of COMPUTREATER, of C. A. RITZLER CO., dried at a temperature of 150° C. for 2 minutes and, then, heat-treated at a temperature of 230° C. for one minute. The resultant dried and heat-treated cord contained 2.2% of the dry solid contents of the first treating liquid, based on the weight of the cord. In the same manner as mentioned above, the first dried and heat-treated cord was impregnated with the second treating liquid, dried and heat-treated. The resultant second dried and heat-treated cord contained 2.9% based on the weight of the cord, of the dry solid contents of the second treating liquid.

The cord obtained as mentioned above was subjected to the tests of the peeling resistance, rubber coverage, tensile strength, resistance to bending and resistance to fatigue. The results are shown in Table 1.

In Comparative Example 1, the same procedures as those mentioned in Example 1 were carried out, except that no sorbitol triglycidyl ether and 20 g of the phenol-blocked 4,4'-diphenylmethane diisocyanate were used.

In Comparative Example 2, the same procedures as those mentioned in Example 1 were effected except that 20 g of sorbitol triglycidyl ether and no phenol-blocked 4,4'-diphenylmethane diisocyanate were used.

In Comparative Example 3, procedures identical to those described in Example 1 were carried out, except that no aqueous emulsion of the vinyl pyridine-styrene-butadiene terpolymer was used. The results are indicated in Table 1.

TABLE 1

| Example No. | Composition of First treating composition: Polyepoxide compound (wt. %) | Blocked polyisocyanate compound (wt. %) | Rubber latex (wt. %) | Peeling resistance (kg/3cm) | Rubber coverage (%) | Tensile strength (kg) | Resistance to bending (mg) | Resistance to fatigue (%) |
|---|---|---|---|---|---|---|---|---|
| Example 1 | 0.6 | 1.4 | 5.0 | 35 | 70 | 22.3 | 1300 | 92 |
| Comparative Example | | | | | | | | |
| 1 | — | 2.0 | 5.0 | 20 | 10 | 22.0 | 780 | 92 |
| 2 | 2.0 | — | 5.0 | 24 | 20 | 22.0 | 1500 | 92 |
| 3 | 0.6 | 1.4 | — | 33 | 60 | 21.5 | 1800 | 85 |

Table 1 clearly shows that the product of Comparative Example 1, in which no polyepoxide compound was used, and the product of Comparative Example 2, wherein no blocked polyisocyanate compound was used, had a poor bonding property to rubber. Also, Table 1 shows that the product of Comparative Example 3 wherein no rubber latex was contained in the first treating liquid, had an undesirably high stiffness and a poor resistance to fatigue.

EXAMPLES 2 TO 7

In Examples 2 and 3, procedures identical to those mentioned in Example 1 were carried out, except that glycerin diglycidyl ether (Example 2) and pentaerythritol diglycidyl ether (Example 3) were substituted for the sorbitol triblycidyl ether.

In Examples 4 and 5, the same procedures as those mentioned in Example 1 were carried out, except that caprolactam-blocked 4,4'-diphenylmethane diisocyanate (Example 4) and phenol-blocked polymethylenepolyphenyl polyisocyanate (Example 5) were substituted for the phenol-blocked 4,4'-diphenylmethane diisocyanate.

In Examples 6 and 7, the same procedures as those mentioned in Example 1 were carried out, except that a styrene-butadiene copolymer latex (Example 6) and a natural rubber latex (Example 7) were substituted for the vinyl pyridine-styrene-butadiene terpolymer latex. The results are shown in Table 2.

TABLE 2

| Ex. No. | Peeling resistance (kg/3cm) | Rubber coverage (%) | Tensile strength (kg) | Resistance to bending (mg) | Resistance to fatigue (%) |
|---|---|---|---|---|---|
| 2 | 30 | 40 | 23.0 | 1,000 | 92 |
| 3 | 34 | 60 | 22.3 | 1,400 | 92 |
| 4 | 35 | 70 | 22.5 | 1,300 | 92 |
| 5 | 34 | 70 | 22.0 | 1,500 | 90 |
| 6 | 30 | 50 | 22.3 | 1,500 | 92 |
| 7 | 25 | 50 | 22.5 | 1,300 | 93 |

Table 2 shows that all products of Examples 2 to 7 have an excellent bonding property to rubber, a proper softness and a high resistance to fatigue.

COMPARATIVE EXAMPLE 4

The same procedures as those mentioned in Example 1 were carried out, except that no second treating liquid was applied.

The resultant product had a poor peeling resistance of 10 kg/3 cm and rubber coverage of 0%, and a tensile strength of 22.5 kg, a high resistance of 2,000 mg to bending and a remaining percent of tensile strength of 98.

EXAMPLES 8 TO 18 AND COMPARATIVE EXAMPLES 5 TO 8

In each of Examples 8 to 18 and Comparison Examples 5 to 8, the same procedures as those mentioned in Example 1 were carried out, except that the sorbitol triglycidyl ether (the polyepoxide compound A), the phenol-blocked 4,4'-diphenylmethane diisocyanate (the blocked polyisocyanate compound B) and the vinylpyridine-styrene-butadiene terpolymer latex (the rubber latex C) were used in a composition shown in Table 3. The results are shown in Table 3.

TABLE 3

| Example No. | Composition of first treating composition (wt %) Polyepoxide compound (A) | Blocked polyisocyanate compound (B) | Rubber latex (C) | Ratio (A)/[(A) + (B)] | Ratio (C)/[(A) + (B)] | Peeling resistance (kg/3cm) | Rubber coverage (%) | Tensile strength (kg) | Resistance to bending (mg) | Resistance to fatigue (%) |
|---|---|---|---|---|---|---|---|---|---|---|
| Comparative Example 5 | 0.06 | 1.94 | 5.0 | 0.03 | 2.5 | 22 | 10 | 21.8 | 800 | 95 |
| Example 8 | 0.12 | 1.88 | 5.0 | 0.06 | 2.5 | 28 | 40 | 22.1 | 1100 | 94 |
| Example 9 | 0.20 | 1.80 | 5.0 | 0.1 | 2.5 | 32 | 60 | 22.2 | 1200 | 92 |
| Example 10 | 0.60 | 1.40 | 5.0 | 0.3 | 2.5 | 35 | 70 | 22.3 | 1300 | 92 |
| Example 11 | 1.0 | 1.0 | 5.0 | 0.5 | 2.5 | 33 | 60 | 22.3 | 1400 | 92 |
| Example 12 | 1.3 | 0.7 | 5.0 | 0.65 | 2.5 | 32 | 60 | 22.2 | 1400 | 92 |
| Example 13 | 1.7 | 0.3 | 5.0 | 0.85 | 2.5 | 29 | 50 | 22.2 | 1400 | 93 |
| Comparative Example 6 | 1.9 | 0.1 | 5.0 | 0.95 | 2.5 | 24 | 30 | 22.3 | 1400 | 95 |
| Comparative Example 7 | 0.6 | 1.4 | 0.6 | 0.3 | 0.3 | 33 | 60 | 21.4 | 1800 | 85 |
| Example 14 | 0.6 | 1.4 | 1.2 | 0.3 | 0.6 | 33 | 60 | 21.5 | 1600 | 87 |
| Example 15 | 0.6 | 1.4 | 2.4 | 0.3 | 1.2 | 34 | 70 | 22.1 | 1400 | 90 |
| Example 16 | 0.6 | 1.4 | 5.0 | 0.3 | 2.5 | 34 | 70 | 22.3 | 1300 | 92 |
| Example 17 | 0.6 | 1.4 | 18.0 | 0.3 | 9.5 | 34 | 70 | 22.1 | 1300 | 92 |
| Example 18 | 0.6 | 1.4 | 29.0 | 0.3 | 14.5 | 31 | 60 | 21.9 | 1200 | 92 |
| Comparative Example 8 | 0.6 | 1.4 | 31.0 | 0.3 | 15.5 | 27 | 30 | 21.5 | 1100 | 93 |

Table 3 clearly shows that, in order to obtain the polyester fiber composite material having not only an excellent bonding property to rubber but also a proper softness and a high resistance to fatigue, the ratio, (A)/[(A)+(B)] should be within the range of from 0.05 to 0.9, preferably, from 0.1 to 0.5, and the ratio, (C)/[(A)+(B)], should be in the range of from 0.5 to 15, preferably, from 1 to 10.

EXAMPLES 19 AND 20 AND COMPARATIVE EXAMPLES 9 TO 11

In Example 19, a first treating liquid was prepared by the same procedures as those mentioned in Example 1. Separately, a primary condensation product of resorcin with formaldehyde was prepared in the presence of an acid catalyst and dissolved in acetone to prepare a 40% by weight solution thereof. An alkali solution was prepared by dissolving 10 g of an aqueous solution of 10% by weight of sodium hydroxide and 30 g of an aqueous solution of 28% by weight of ammonia in 260 g of water, while thoroughly stirring the mixture 60 g of the acetone solution of resorcin-formaldehyde condensation product were dispersed in the above-prepared alkali solution while thoroughly stirring the mixture.

Next, 240 g of an aqueous emulsion of 40% by weight of a vinyl pyridine-styrene-butadiene terpolymer (Nippol 2518FS) and 100 g of an aqueous emulsion of 40% by weight of a styrene-butadiene copolymer, which was available under the trademark of NIPPOL LX-112, of NIPPON ZEON, were mixed together and diluted by 200 g of water. The above-obtained dispersion of the primary condensation product of resorcin with formaldehyde was added dropwise to the diluted emulsion while slowly stirring the mixture, and then, the resultant mixture was admixed with 20 g of an aqueous solution of 37% by weight of formaldehyde. Finally, the admixture was uniformly mixed with an aqueous dispersion which had been obtained by mixing 20 g of diphenylmethane diethylene urea, 7 g of the sodium dioctylsulfosuccinate (Neocol SW-30) and 53 g of water, by using a ball mill for 24 hours. The resultant liquid mixture was used as a second treating liquid.

The first and second treating liquids obtained above were applied to the same polyester fiber reinforcing ply as that used in Example 1 in the same manner as that mentioned in Example 1. The same tests as those mentioned in Example 1 were applied to the resultant product.

In Comparative Example 9, the same procedures as those mentioned in Example 19 were carried out, except that no sorbital triglycidyl ether and 20 g of the phenol-blocked 4,4'-diphenylmethane diisocyanate were used.

In Comparative Example 10, the same procedures as those mentioned in Example 19 were carried out, except that 20 g of the sorbital triglycidyl ether and no phenol-blocked 4,4'-diphenylmethane diisocyanate were used.

In Comparative Example 11, procedures identical to those mentioned in Example 19 were carried out, except that no vinyl pyridive-styrene-butadiene terpolymer was used.

In Example 20, the same procedures as those mentioned in Example 19 were carried out, except that no diphenylmethane diethylene urea was contained in the second treating liquid.

The results are shown in Table 4.

TABLE 4

| Example No. | Composition of first treating composition (wt %) Polyepoxide compound | Blocked polyisocyanate compound | Rubber latex | Ethylene urea compound in second treating composition | Peeling resistance (kg/3cm) | Rubber coverage (%) | Tensile strength (kg) | Resistance to bending (mg) | Resistance to fatigue (%) |
|---|---|---|---|---|---|---|---|---|---|
| Example 19 | 0.6 | 1.4 | 5.0 | yes | 39 | 90 | 22.4 | 1200 | 92 |
| Comparative Example 9 | — | 2.0 | 5.0 | yes | 20 | 10 | 22.0 | 780 | 92 |
| Example 10 | 2.0 | — | 5.0 | yes | 24 | 10 | 22.0 | 1500 | 92 |
| Example 11 | 0.6 | 1.4 | — | yes | 33 | 70 | 21.3 | 2000 | 85 |
| Example 20 | 0.6 | 1.4 | 5.0 | no | 35 | 70 | 22.3 | 1300 | 92 |

Table 4 shows that the bonding property of the product of Example 19 is higher than that of Example 20, wherein no ethylene urea compound was contained in the second treating liquid. Also, Table 4 shows that the product of Comparative Example 9, in which no polyepoxide compound was used, and the product of Comparative Example 10, in which no blocked polyisocyanate compound was used, had a poor bonding property to rubber. Also, the product of Comparative Example 11, wherein no rubber latex was contained in the first treating liquid, had an undesirably high stiffness and a poor resistance to fatigue.

EXAMPLES 21 TO 24

In Example 21, the same procedures as those mentioned in Example 19 were carried out, except that the sorbitol triglycidyl ether was replaced by pentaerythritol diglycidyl ether.

In Example 22, the same procedures as those mentioned in Example 19 were repeated, except that the phenol-blocked 4,4'-diphenylmethane diisocyanate was replaced with an ϵ-caprolactam-blocked 4,4'-diphenylmethane diisocyanate.

In Example 23, the same procedures as those mentioned in Example 19 were repeated, except that the phenol-blocked 4,4'-diphenylmethane diisocyanate was replaced with a phenol-blocked polymethylene polyphenyl polyisocyanate.

In Example 24, the same procedures as those mentioned in Example 12, were carried out, except that a styrene-butadiene copolymer was used in place of the vinyl pyridine-styrene-butadiene terpolymer.

The results are shown in Table 5.

TABLE 5

| Ex. No. | Peeling resistance (kg/3cm) | Rubber coverage (%) | Tensile strength (kg) | Resistance to being (mg) | Resistance to fatigue (%) |
|---|---|---|---|---|---|
| 21 | 38 | 80 | 22.3 | 1400 | 92 |
| 22 | 39 | 90 | 22.5 | 1300 | 92 |

TABLE 5-continued

| Ex. No. | Peeling resistance (kg/3cm) | Rubber coverage (%) | Tensile strength (kg) | Resistance to being (mg) | Resistance to fatigue (%) |
|---|---|---|---|---|---|
| 23 | 38 | 90 | 22.0 | 1500 | 90 |
| 24 | 37 | 70 | 22.3 | 1500 | 92 |

Table 5 shows that all products of Examples 21 through 24 respectively had an excellent bonding property to rubber, a proper softness and a high resistance to fatigue.

EXAMPLE 25, 26 AND 27

The same procedures as those described in Example 19 were carried out three times, except that the diphenylmethane diethylene urea was replaced with tolylene diethylene urea (Example 25), hexamethylene diethylene urea (Example 26) and triphenylmethane triethylene urea (Example 27). The results are shown in Table 6.

TABLE 6

| Ex. No. | Peeling resistance (kg/3cm) | Rubber coverage (%) | Tensile strength (kg) | Resistance to bending (mg) | Resistance to fatigue (%) |
|---|---|---|---|---|---|
| 25 | 37 | 90 | 22.2 | 1200 | 92 |
| 26 | 38 | 90 | 22.5 | 1000 | 93 |
| 27 | 39 | 90 | 22.0 | 1500 | 90 |

Table 6 shows that all products of Examples 25 through 27 had an excellent bonding property to rubber, a proper softness and a high resistance to fatigue.

EXAMPLES 28 TO 42

In each of the Examples 28 through 42, the same procedures as those described in Example 19 were carried out, except that the sorbitol trigylcidyl ether (polyepoxide compound A), the phenol-blocked 4,4'-diphenylmethane dirsocyanate (blocked polyisocyanate compound B) and the vinyl pyridine-styrene-butadiene terpolymer (rubber latex C) were used in a composition as indicated in Table 7. The results are shown in Table 7.

TABLE 7

| Example No. | Composition of first treating composition (wt %) Polyepoxide compound (A) | Blocked polyisocyanate compound (B) | Rubber latex (C) | Ratio (A)/(A) + (B) | Ratio (C)/(A) + (B) | Peeling resistance (kg/3cm) | Rubber coverage (%) | Tensile strength (kg) | Resistance to bending (mg) | Resistance to fatigue (%) |
|---|---|---|---|---|---|---|---|---|---|---|
| Example 28 | 0.06 | 1.94 | 5.0 | 0.03 | 2.5 | 28 | 30 | 22.0 | 900 | 94 |
| Example 29 | 0.12 | 1.88 | 5.0 | 0.06 | 2.5 | 33 | 60 | 22.3 | 1000 | 93 |
| Example 30 | 0.2 | 1.80 | 5.0 | 0.1 | 2.5 | 38 | 80 | 22.4 | 1200 | 92 |
| Example 31 | 0.6 | 1.40 | 5.0 | 0.3 | 2.5 | 39 | 90 | 22.4 | 1200 | 92 |
| Example 32 | 1.0 | 1.0 | 5.0 | 0.5 | 2.5 | 39 | 80 | 22.3 | 1300 | 92 |
| Example 33 | 1.3 | 0.7 | 5.0 | 0.65 | 2.5 | 38 | 80 | 22.3 | 1300 | 92 |
| Example 34 | 1.7 | 0.3 | 5.0 | 0.85 | 2.5 | 34 | 70 | 22.3 | 1300 | 93 |
| Example 35 | 1.9 | 0.1 | 5.0 | 0.95 | 2.5 | 28 | 50 | 22.3 | 1200 | 94 |
| Example 36 | 0.6 | 1.4 | 0.06 | 0.3 | 0.3 | 36 | 80 | 21.5 | 1900 | 86 |
| Example 37 | 0.6 | 1.4 | 0.12 | 0.3 | 0.6 | 37 | 80 | 21.6 | 1700 | 88 |
| Example 38 | 0.6 | 1.4 | 2.4 | 0.3 | 1.2 | 38 | 90 | 22.3 | 1500 | 91 |
| Example 39 | 0.6 | 1.4 | 5.0 | 0.3 | 2.5 | 39 | 90 | 22.4 | 1200 | 92 |
| Example 40 | 0.6 | 1.4 | 18.0 | 0.3 | 9.5 | 39 | 90 | 22.3 | 1200 | 92 |
| Example 41 | 0.6 | 1.4 | 29.0 | 0.3 | 14.5 | 36 | 80 | 22.0 | 1100 | 92 |
| Example 42 | 0.6 | 1.4 | 31.0 | 0.3 | 15.5 | 33 | 50 | 21.6 | 1100 | 93 |

Table 7 shows that the ratio, (A)/[(A)+(B)] should be in a range of from 0.05 to 0.9, preferably, from 0.1 to 0.5, and the ratio, (C)/[(A)+(B)] should be in a range of from 0.5 to 15, preferably from 1 to 10.

What we claim is:

1. A process for preparing a polyester fiber composite material useful for reinforcing rubber articles, comprising the steps of:

(a) impregnating a polyester fiber material with a first treating liquid containing a first treating composition consisting essentially of (A) at least one polyepoxide compound, (B) at least one blocked polyisocyanate compound and (C) at least one rubber latex selected from the group consisting of natural rubber, styrene-butadiene copolymer, vinyl pyridine-styrene-butadiene terpolymer and nitrile rubber latexes, the ratio in dry weight of said polyepoxide compound to the sum of said polyepoxide compound and said blocked polyisocyante compound being in a range of from 0.05 to 0.9 and the ratio in dry weight of said rubber latex to the sum of said polyepoxide compound and said blocked polyisocyanate compound being in a range of from 0.5 to 15;

(b) drying and heating said impregnated polyester fiber material of step (a) at a temperature lower than the melting point of said polyester fiber material;

(c) impregnating said dried and heat-treated polyester fiber material of step (B) with a second treating liquid containing a second treating composition consisting essentially of (D) a reaction product between resorcin and formaldehyde and (E) at least one rubber latex selected from the group consisting of natural rubber, styrene-butadiene copolymer, vinyl pyridine-styrene-butadiene terpolymer and nitrile rubber latexes, and;

(e) drying and heat treating said impregnated polyester fiber material of step (c) at a temperature lower than the melting point of said polyester fiber material.

2. A process as claimed in claim 1, wherein the weight ratio of said polyepoxide compound to the sum of said polyepoxide compound and said blocked polyisocyanate compound is in a range of from 0.1 to 0.5 and the weight ratio of said rubber latex to the sum of said polyepoxide compound and said blocked polyisocyanate compound is in a range of from 1 to 10.

3. A process as claimed in claim 1, wherein said polyepoxide compound contains at least two epoxy groups per molecule of said compound, the amount of said epoxy groups being a gram equivalent of 0.2 or more per 100 g of said compound.

4. A process as claimed in claim 1, wherein said polyepoxide compound is selected from the group consisting of reaction products of polyhydric alcohols with halogenated epoxide compounds, reaction products of polyhydric phenol compounds with halogenated epoxide compounds and oxidation products of unsaturated organic compounds having at least one aliphatic double bond with peracetic acid or hydrogen peroxide.

5. A process as claimed in claim 1, wherein said polyepoxide compound is selected from polyglycidyl ethers of polyhydric alcohols, which are reaction products of epichlorohydrin with polyhydric alcohols.

6. A process as claimed in claim 4 or 5, wherein said polyhydric alcohol is selected from the group consisting of ethylene glycol, glycerol, sorbitol, pentaerythritol and polyethylene glycols.

7. A process as claimed in claim 4, wherein said halogenated epoxide compound is epichlorohydrin.

8. A process as claimed in claim 4, wherein said polyhydric phenol compound is selected from the group consisting of resorcin, bis (4-hydroxyphenyl)dimethylmethane, phenol-formaldehyde resins and resorcin-formaldehyde resins.

9. A process as claimed in claim 4, wherein said oxidation product is selected from the group consisting of 4-vinyl cyclohexene dioxide, 3,4-epoxycyclohexylmethyl-3,4-epoxycyclohexene carboxylate and bis(3,4-epoxy-6-methylcyclohexylmethyl)adipate.

10. A process as claimed in claim 1, wherein said blocked isocyanate compound is selected from addition products of polyisocyanate compounds with blocking agents.

11. A process as claimed in claim 10, wherein said blocking agent is selected from the group consisting of phenol compounds, tertiary alcohol compounds, aromatic secondary amine compounds, aromatic imide compounds, lactam compounds, oxime compounds and sodium hydrogen sulfite.

12. A process as claimed in claim 11, wherein said phenol compound is selected from the group consisting of phenol, thiophenol, cresol and resorcin.

13. A process as claimed in claim 11, wherein said tertiary alcohol compounds is either t-butyl alcohol or t-pentyl alcohol.

14. A process as claimed in claim 11, wherein said aromatic secondary amine compound is either diphenyl amine or xylidine.

15. A process as claimed in claim 11, wherein said aromatic imide is phthalic acid imide.

16. A process as claimed in claim 11, wherein said lactam compound is either caprolactam or valerolactam.

17. A process as claimed in claim 11, wherein said oxime compound is selected from the group consisting of acetoxim, methylethylketone oxime and cyclohexaneoxim.

18. A process as claimed in claim 10, wherein said isocyanate compound is selected from the group consisting of tolylene diisocyanate, m-phenylene diisocyanate, diphenylmethane diisocyanate, hexamethylene diisocyanate, polymethylenepolyphenyl isocyanates, triphenylmethane triisocyanate, and adducts of polyalkyleneglycols with polyisocyanates.

19. A process as claimed in claim 1, wherein each of said rubber latexes (C) and (E) contains at least 50% by weight of vinyl pyridine-styrene-butadiene terpolymer latex.

20. A process as claimed in claim 1, wherein the total dry weight content of said first treating composition in said first treating liquid is in a range of from 1 to 30%.

21. A process as claimed in claim 1, wherein said first treating liquid contains, in addition to said first treating composition, a surface active agent in an amount less than 15% based on the total weight of said first treating composition.

22. A process as claimed in claim 1, wherein the molar ratio of said resorcin to said formaldehyde is in a range of from 1:0.1 to 1:8.

23. A process as claimed in claim 1, wherein the ratio in dry weight of said resorcin-formaldehyde reaction product to said rubber latex in said second treating composition is in a range of from 1:1 to 1:20.

24. A process as claimed in claim 1, wherein said second treating composition contains at least one ethylene urea compound of the formula:

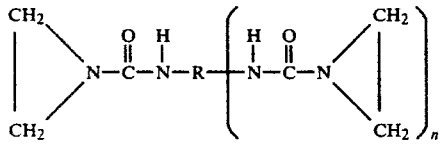

wherein R stands for an aromatic or aliphatic hydrocarbon residue and n is 0, 1 or 2, in addition to said resorcin-formaldehyde reaction product and said rubber latex.

25. A process as claimed in claim 24, wherein said ethylene urea compound is a reaction product of ethyleneimine with an isocyanate selected from the group consisting of octadecylisocyanate, hexamethylenediisocyanate, isophoronediisocyanate, tolylenediisocyanate, methaxylenediisocyanate, diphenylmethanediisocyanate, naphthylenediisocyanate, and triphenylmethanetriisocyanate.

26. A process as claimed in claim 24, wherein the amount of said ethylene urea compound is in a range of from 0.5 to 30% based on the total dry weight of said resorcin-formaldehyde reaction product and the rubber latex.

27. A process as claimed in claim 1, wherein the total dry weight content of second treating composition in said second treating liquid is in a range of from 10 to 25%.

28. A process as claimed in claim 1, wherein said first drying and heat-treating temperature is 180° C. or higher but lower than the melting point of said polyester fiber material.

29. A process as claimed in claim 28, wherein said first drying and heat-treating temperature is in a range of from 220° to 250° C.

30. A process as claimed in claim 1, wherein said second drying and heat treating temperature is in a range of from 120° C. to a temperature lower than the melting point of said polyester fiber material.

31. A process as claimed in claim 30, wherein said second drying and heat-treating temperature is in a range of from 180° to 250° C.

32. A process as claimed in claim 1 wherein said first impregnated polyester fiber material contains said first treating composition in an amount of from 0.1 to 10% based on the weight of said polyester fiber material.

33. A process as claimed in claim 32, wherein the amount of said first treating composition contained in said first impregnated polyester fiber material is in a range of from 0.5 to 5% based on the weight of said polyester fiber material.

34. A process as claimed in claim 1, wherein said second impregnated polyester fiber material contains said second treating composition in an amount of from 0.5 to 10% based on the weight of said polyester fiber material.

35. A process as claimed in claim 34, wherein the amount of said second treating composition contained in said second impregnated polyester fiber material is in a range of from 1 to 5% based on the weight of said polyester fiber material.

36. A process as claimed in claim 1, wherein said polyester fiber material consists of polyethylene terephthalate or polyethylene naphthalate.

37. A process as claimed in claim 1, wherein said polyester fiber material is selected from the group consisting of polyester fiber or filament fabrics, cords and threads.

38. A polyester fiber composite material useful for reinforcing rubber articles, comprising a polyester fiber material;

a first impregnating composition layer with which said polyester fiber material is impregnated, consisting essentially of (A) at least one polyepoxide compound, (B) at least one blocked polyisocyanate compound and (C) at least one rubber latex selected from the group consisting of natural rubber, styrene-butadiene copolymer, vinyl pyridine-styrene-butadiene terpolymer and nitrile rubber latexes, and which has been heat-treated at a temperature lower than the melting point of said polyester fiber material, the ratio in dry weight of said polyepoxide compound to the sum of said polyepoxide compound and said blocked polyisocyanate compound being in a range of from 0.05 to 0.9 and the ratio in dry weight of said rubber latex to the sum of said polyepoxide compound and said blocked polyisocyanate compound being in a range of from 0.5 to 15, and;

a second impregnating composition layer which is formed on said first impregnating composition layer, which contains (D) a reaction product of resorcin with formaldehyde and (E) at least one rubber latex selected from the group consisting of natural rubber, styrene-butadiene copolymer, vinyl pyridine-styrene-butadiene terpolymer and nitrile rubber latexes and which has been heat-treated at a temperature lower than the melting point of said polyester fiber material.

39. A polyester fiber composite material as claimed in claim 38, wherein said second impregnating composition layer contains, in addition to said resorcin-formaldehyde reaction product (D) and said rubber latex (E), at least one ethylene urea compound of the formula:

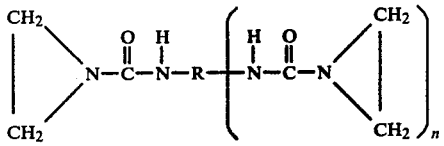

wherein R stands for an aromatic or aliphatic hydrocarbon residue and n is 0,1 or 2.

* * * * *

UNITED STATES PATENT AND TRADEMARK OFFICE

CERTIFICATE OF CORRECTION

PATENT NO. : 4,248,938

DATED : Feb. 3, 1981

INVENTOR(S) : Tadahiko Takata, et al

It is certified that error appears in the above—identified patent and that said Letters Patent is hereby corrected as shown below:

In the title page, under inventor information: "Ibaraki" (both occurrences) should be --Osaka--; "Ashiya" should be --Hyogo-ken--.

In the title page, the name of the law firm which prosecuted this case should be --Burgess, Ryan and Wayne--.

In column 17, line 19: "acetoxim" should read --acetoxime--.

lines 19-20: "cyclohexaneoxim" should read --cyclohexaneoxime--.

Signed and Sealed this

Eleventh Day of August 1981

[SEAL]

Attest:

GERALD J. MOSSINGHOFF

Attesting Officer

Commissioner of Patents and Trademarks